United States Patent [19]

Butler et al.

[11] 4,116,275

[45] Sep. 26, 1978

[54] RECOVERY OF HYDROCARBONS BY IN SITU THERMAL EXTRACTION

[75] Inventors: Roger Moore Butler; Caurino Cesar Bombardieri; Bruce Alexander Slevinsky, all of Calgary, Canada

[73] Assignee: Exxon Production Research Company, Houston, Tex.

[21] Appl. No.: 777,292

[22] Filed: Mar. 14, 1977

[51] Int. Cl.[2] ..... E21B 43/24

[52] U.S. Cl. ..... 166/303; 166/57; 166/50

[58] Field of Search ..... 166/303, 272, 263, 57, 166/50

[56] References Cited

U.S. PATENT DOCUMENTS

| | | | |
|---|---|---|---|
| 2,421,528 | 6/1947 | Steffen | 166/303 |
| 3,155,160 | 11/1964 | Craig, Jr. et al. | 166/303 |
| 3,333,637 | 8/1967 | Prats | 166/303 X |
| 3,386,508 | 6/1968 | Bielstein et al. | 166/303 X |
| 3,434,544 | 3/1969 | Satter et al. | 166/303 |
| 3,515,213 | 6/1970 | Prats | 166/303 X |
| 3,583,488 | 6/1971 | Hutchison | 166/303 |
| 3,620,571 | 11/1971 | Billings | 166/303 X |
| 3,986,557 | 10/1976 | Striegler et al. | 166/303 X |

*Primary Examiner*—Stephen J. Novosad
*Attorney, Agent, or Firm*—Gary D. Lawson; Michael D. Nametz

[57] ABSTRACT

Disclosed is a method for recovering hydrocarbons from a hydrocarbon-bearing formation. A wellbore is drilled to penetrate the formation and to extend, preferably substantially horizontally, into the formation for a suitable distance. The well is completed with a slotted or perforated casing means and with dual concentric tubing strings. The tubing strings comprise an inner tubing and a surrounding larger diameter outer tubing. The inner tubing cooperates with the outer tubing to form a first annular space and the outer tubing cooperates with the casing means to form a second annular space. After the wellbore is suitably completed, a heated fluid is circulated within the casing means such that the heated fluid passes through a portion of the first annular space to heat the well and to provide a fluid flow path through both the first and second annular spaces. After the well is suitably heated, a heated fluid is injected into the formation through at least a portion of the second annular space. Subsequently, formation hydrocarbons are produced from formation by means of the well.

22 Claims, 2 Drawing Figures

RECOVERY OF HYDROCARBONS BY IN SITU THERMAL EXTRACTION

BACKGROUND OF THE INVENTION

1. Field of the Invention

This invention relates to a process including a shaft or deep boring in the earth, commonly known as wells, for the extraction of fluids from the earth. More particularly, this invention relates to a process for recovering hydrocarbon from a subterranean formation using a well or wells for injection and production and including heating steps.

2. Description of the Prior Art

In many areas of the world, there are large deposits of viscous petroleum. Examples of viscous petroleum deposits include the Athabasca and Peace River regions in Canada, the Jobo region in Venezuela and the Edna and Sisquoc regions in California. These deposits are generally called tar sand deposits due to the high viscosity of the hydrocarbon which they contain. These tar sands may extend for many miles and may occur in varying thickness of up to more than 300 feet. Although tar sands may lie at or near on the earth's surface, generally they are located under an overburden which ranges in thickness from a few feet to several thousand feet. The tar sands located at these depths constitute one of the world's largest presently known petroleum deposits.

The tar sands contain a viscous hydrocarbon material, which is commonly referred to as bitumen, in an amount which ranges from about 5 to about 20 percent by weight. This bitumen is usually immobile at typical reservoir temperatures. For example, at reservoir temperatures of about 48° F, bitumen is immobile, having a viscosity frequently exceeding several thousand poises. At higher temperatures, such as temperatures exceeding 200° F, the bitumen becomes mobile with a viscosity of less than 345 centipoises.

In situ heating is among the most promising methods for recovering bitumen from tar sands because there is no need to move the deposit and thermal energy can substantially reduce the bitumen viscosity. The thermal energy may be introduced to the tar sands in a variety of forms. For example, hot water, in situ combustion, and steam have been suggested to heat tar sands. Although each of these thermal energy agents may be used under certain conditions, steam is generally the most economical and efficient and is clearly the most widely employed thermal energy agent.

Thermal stimulation processes appear promising as one approach for introducing these thermal agents into a formation to facilitate flow and production of bitumen therefrom. In a typical steam stimulation process, steam is injected into a viscous hydrocarbon deposit by means of a well for a period of time after which the steam-saturated formation is allowed to soak for an additional interval prior to placing the well on production.

To accelerate the input of heat into the formations, it has been proposed to drill horizontally deviated wells or to drill lateral holes outwardly from a main borehole or tunnel. Examples of various thermal systems using horizontal wells are described in U.S. Pat. No. 1,634,236, Ranney; U.S. Pat. No. 1,816,260, Lee; 2,365,591, Ranney; 3,024,013, Rogers et al; 3,338,306, Cook; 3,960,213, Striegler et al; 3,986,557, Striegler et al; and, Canadian Pat. No. 481,151, Ranney. However, processes which use horizontal wells to recover bitumen from tar sand deposits are subject to several drawbacks.

One problem encountered with use of horizontal wells to recover bitumen is the difficulty of passing a heated fluid through the horizontal well. During well completion bitumen will sometimes drain into the well completion assembly. This bitumen may block fluid flow through substantial portions of the horizontal well and thereby decrease heating efficiency.

Another problem encountered with using horizontal wells for recovering bitumen by thermal processes is the difficulty of recovering bitumen which drains into the well. Conventional mechanically energized pumps or pneumatically energized displacement pumps are generally not satisfactory for recovering bitumen from horizontal wells. It has been proposed to use the formation pressure to move the bitumen through the horizontal section of the well and to lift the bitumen to the earth's surface. It is well known, for example, that wells which have been stimulated by "huff and puff" processes sometimes need no artificial lifting due to the hydrocarbon viscosity reduction and to the increased pressure resulting from steam injection. However, to economically recover fluids by this method, the viscosity of the production fluids must be kept relatively low. As bitumen is produced through conventional horizontal wells it has a tendency to cool and to increase in viscosity to the point where the formation pressure will no longer force it to the earth's surface. As a consequence, the efficiency of the steam stimulation process declines.

There is a substantially unfilled need for a thermal system using substantially horizontal wells to effectively recover bitumen from tar sand deposits.

SUMMARY OF THE INVENTION

In accordance with the present invention, hydrocarbons are recovered from a subterranean formation by using the following method. First, a wellbore is drilled to penetrate the formation and to extend into the formation for a suitable distance. Preferably, the wellbore extends substantially horizontally through the formation and near the bottom thereof. The well is completed with a slotted or perforated casing means and with dual concentric tubing strings. The tubing strings, which comprise an inner tubing and a surrounding larger diameter outer tubing are disposed within the casing means. The inner tubing cooperates with the outer tubing to form a first annular space and the outer tubing cooperates with the casing means to form a second annular space. After the wellbore is suitably completed, a heated fluid is circulated within the casing means such that the heated fluid passes through a portion of the first annular space to heat the well and to provide a fluid flow path through both the first and second annular spaces. After the well is suitably heated, a heated fluid is injected into the formation through at least a portion of the second annular space. Subsequently, formation hydrocarbons are produced from formation by means of the well.

In practicing the preferred embodiment of this invention, steam is circulated down the first and second annular spaces and up the inner tubing to heat the well apparatus and to remove hydrocarbons which have accumulated in the second annular space during well completion. Initially, flow through the second annular space may be blocked with viscous hydrocarbons. In that event, steam is circulated through the first annular space to heat and mobilize the viscous hydrocarbons in the second annular space. After steam flow is established through both the first and second annular spaces, steam injection continues to heat the well to a desired temperature. Steam is then injected into the formation through the second annular space. Preferably, during steam injection into the formation, steam condensate and formation hydrocarbons that accumulate in the well are withdrawn continually through the inner tubing. A gas is preferably introduced into the first annular space to insulate the production fluid in the inner tubing from steam in the second annular space. After a suitable injection period the well is shut in and the formation is permitted to heat-soak. Subsequently, the well is placed on production and formation fluids are produced through the inner conduit. To facilitate formation fluid production through the inner tubing, it is sometimes desirable to simultaneously circulate low pressure steam down the second annular space and up the inner tubing.

The practice of this invention substantially reduces problems associated with injecting hot fluid into viscous hydrocarbon-containing formations by means of horizontal wells. The method also facilitates production of formation fluids from formations penetrated by horizontal wells. This method therefore offers significant advantages over the methods used heretofore.

DESCRIPTION OF THE PREFERRED EMBODIMENT

Figure 1:
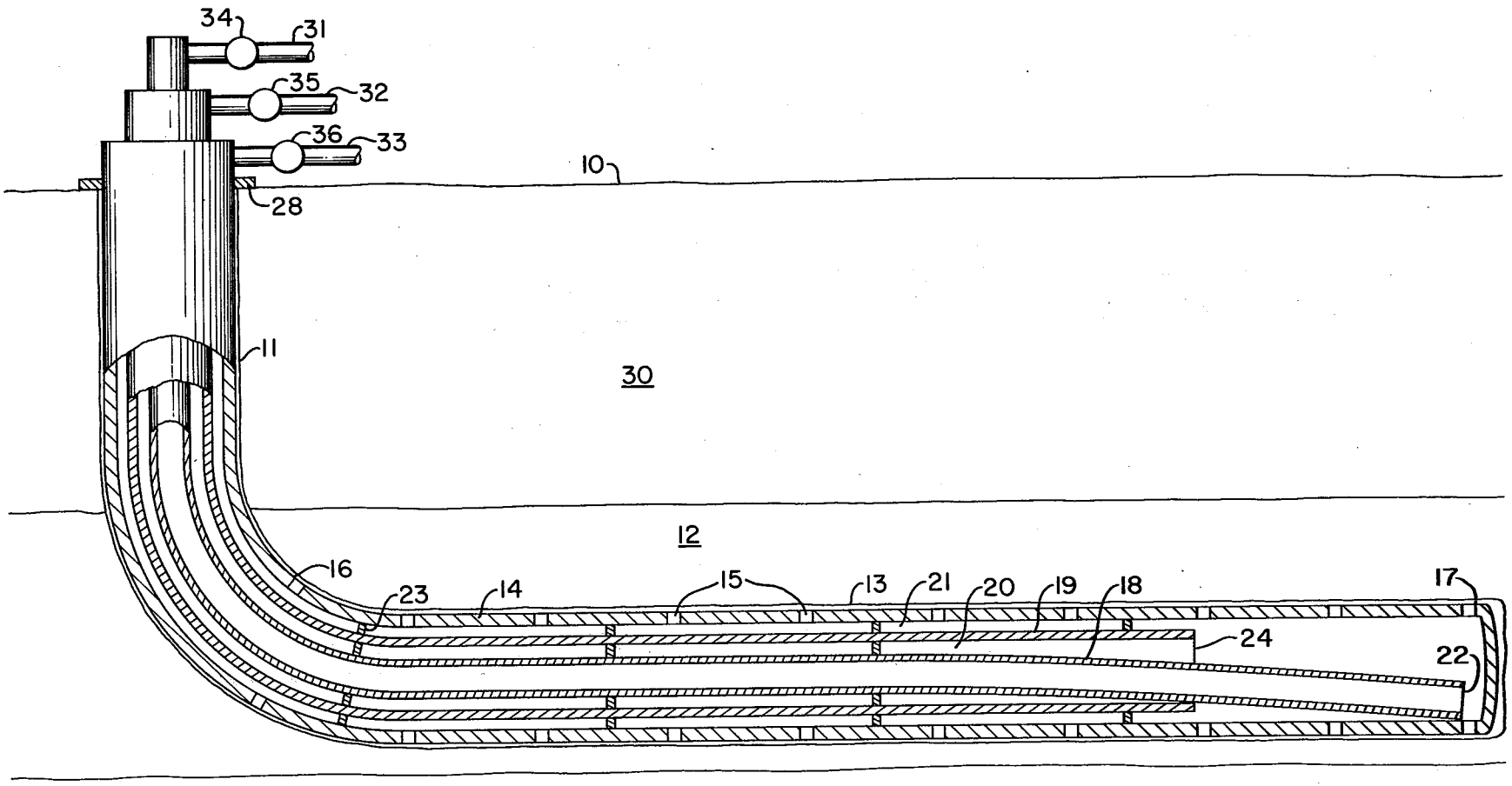
FIG. 1 illustrates a vertical cross-section of a well completion apparatus which penetrates a subterranean formation and extends substantially horizontally through the formation.

Referring to FIG. 1, the drawing illustrates a subterranean formation 12 which contains tar sands disposed below the earth's surface 10, beneath an overburden 30. A wellbore having a substantially vertical section 11 and a substantially horizontal section 13 has been drilled to penetrate tar sand formation 12 and to extend therethrough. A continuous casing element 14, commonly called a liner, having perforations or slots 15 located between points 16 and 17 is shown extending the entire length of the wellbore. Dual concentric tubing strings 18 and 19 are disposed inside the liner 14. The inner tubing 18 is disposed within the surrounding larger diameter outer tubing 19. Inner tubing 18 cooperates with the outer tubing 19 to form an annular space 20 and the outer tubing 19 cooperates with the casing element 14 to form an annular space 21. The lower end 22 of the inner tubing extends to near the lower end of the casing element 14 and extends for a suitable distance beyond the lower end 24 of the outer tubing 19. Centralizers 23 are installed at various intervals in the annular spaces 20 and 21 to centralize the inner tubing within the outer tubing and to centralize the outer tubing within the liner. It is understood that the centralizers are not continuous and they do not block fluid flow in the annular spaces. The centralizers are appropriately positioned to allow the lower portion of the inner tubing to rest on the bottom of the liner 14. The concentric tubing strings and the liner pass through a wellhead 28 and communicate with the usual production conduits 31–33 having the usual flow control valves 34–36.

In carrying out a preferred embodiment of this invention and referring to FIG. 1, a wellbore 11 is drilled to penetrate a subterranean tar sand formation 12 and to extend substantially horizontally a suitable distance through the formation near the bottom thereof. The techniques for drilling horizontally deviated wellbores are well known and, therefore, will not be discussed further herein. After the wellbore has been drilled, the drill bit is removed and a perforated liner 14 is positioned inside the drill string. The drill string is then removed and dual concentric tubing strings 18 and 19 are run into the liner. It should be appreciated that the concentric tubing and the liner may be run into the wellbore in any convenient order. Both concentric tubing strings extend to near the lower end of the liner and are in flow communication with the formation through perforations 15. Preferably, the inner tubing 18 is longer than the outer tubing 19 and the lower end 22 of the inner tubing rests on the bottom of the liner as shown in FIG. 1.

After the well has been completed, a heated fluid is introduced into the annular spaces 20 and 21 at a sufficient pressure to provide circulation down annular space 20 and/or annular space 21 and up the inner tubing 18. To faciliate circulation of the heated fluid, the inner tubing 18 may be withdrawn into the inner tubing 19 until circulation is established. The inner tubing may then be gradually extended to its preferred operating position as shown in FIG. 1. Normally, fluid flow through annular space 20 is established before fluid flow is established through annular space 21 because annular space 21 will normally contain viscous hydrocarbons which have drained into the well during the well completion stage. These viscous hydrocarbons may bank up and form an impermeable barrier to fluid flow through annular space 21. Hot fluid flow through annular space 20 heats and mobilizes the viscous hydrocarbons in annular space 21. After a suitable heating interval, the steam introduced into annular space 21 will displace the bitumen therefrom and sweep it to the earth's surface through inner tubing 18. After fluid flow in annular space 21 is established, hot fluid circulation continues down both annular spaces 20 and 21 and up inner tubing 18 until the well completion assembly is suitably heated. This heating interval may range from 1 to 48 hours, depending on the characteristics of the formation and the design of the well completion apparatus.

After the well is suitably heated a heated fluid, preferably steam, is injected into the annular space 21 under sufficient pressure to force the heated fluid through perforations 15 into the formation 12. The injection pressure of the heated fluid should exceed the formation pressure to the extent required to drive the heated fluid into the formation. Suitable injection pressures range from 100 to 5000 psig, depending upon the depth and permeability of the formation. The pressure of the injected hot fluids may be either above or below the pressure required to fracture the formation. Injection pressures below the fracture pressure of the formation will normally utilize energy more efficiently. Fluid injection into the formation continues for such time as required to raise the temperature of the formation sufficiently to lower the viscosity of the bitumen contained therein and to cause the bitumen to mobilize for a desired distance around the horizontal well. This time interval can be determined by application of heat flow theory and by considering such factors as thermal capacity of tar sands, the thermal content of the injected steam or hot fluid, and the viscosity of the bitumen. Typically, where the hot fluid is steam, the steam injection interval continues for a period from about 1 to about 40 days.

Where the hot fluid injected into the formation is steam, it is preferred that the hot liquids be continuously withdrawn through inner tubing 19 simultaneously with injection of the steam. These liquids will include steam condensate and formation hydrocarbons which accumulate in the well. The production of this liquid should be regulated to minimize steam flow into the inner tubing.

Preferably, a gas is introduced into annular space 20 to displace heated fluid therefrom. This gas space serves as an insulating medium between steam in annular space 21 and fluids in the inner tubing and thereby aids in maximizing heat efficiency. Suitable gases include natural gas, nitrogen, carbon dioxide, hydrocarbon vapors or any material existing in a gaseous state at the conditions of the annular space 20. In some instances, it may be preferred to continuously inject this gas into annular space 20 at a low flow rate while passing a heated fluid through annular space 21.

Following injection of heated fluid into the formation, it is generally preferred to shut the well in and to permit the formation to "heat soak". During this heat soaking period, the heated volume of the tar sand deposit around the well expands considerably. Although this soak period is not essential to the practice of the invention, it will mobilize larger amounts of bitumen and facilitate gravity drainage of bitumen into the well.

After a suitable soak period, the well is then open to production and the formation fluids are withdrawn through the inner tubing 18. The produced fluids will include a mixture of bitumen, steam and water condensate (including steam condensate). Production of these fluids is carried out with a controlled back-pressure on the well to assure that excess steam does not flow from the reservoir into the well. By reducing steam production, the latent heat of condensation released during the injection period is allowed to remain in the formation. The wellhead pressure is gradually reduced during the well cycle until, at the end of the cycle, it is at as low a level as can be achieved with the wellhead equipment available. This pressure reduction greatly improves gravity drainage of bitumen from the formation. As formation pressure decreases, bitumen is forced out of the formation by the expansion of high pressure steam present in the formation and by the gases generated by vaporization of the hot water and hydrocarbons resulting from pressure reduction. Production fluids will continue to flow from the inner conduit 18 until the formation pressure is no longer sufficient to force the bitumen through the horizontal portion of the well and lift it to the earth's surface. In some cases a vacuum may be applied to the inner tubing after the pressure is released to further facilitate production.

Although not essential to the practice of this invention, it is sometimes desirable during the production stage, to circulate low pressure steam or heated gas down the annular space 21 and up the inner tubing 18. The steam will facilitate upward flow of production fluid through tubing 18 by heating the production fluids and by decreasing the weight of the fluid column within the tubing. Circulation of steam in this manner is particularly desirable if the production fluids are devoid of water which can flash and reduce the average density in the well production tubing or if the production fluids are unusually cool.

When the production declines to an uneconomic level, steam may again be injected into the formation. The above described steps of injecting steam into the formation, permitting the formation to soak and then producing the formation can be repeated cyclically in any manner that proves desirable from an economic standpoint depending on the characteristics of the formation and the bitumen content therein. The length of the injection period, the length of the soak period and the length of the production period will depend upon the characteristics of the formation. These periods may extend over several hours or weeks. It is contemplated that the first cycle will extend for only a few hours and each subsequent cycle will extend for longer time intervals, eventually extending up to several months.

Figure 2:
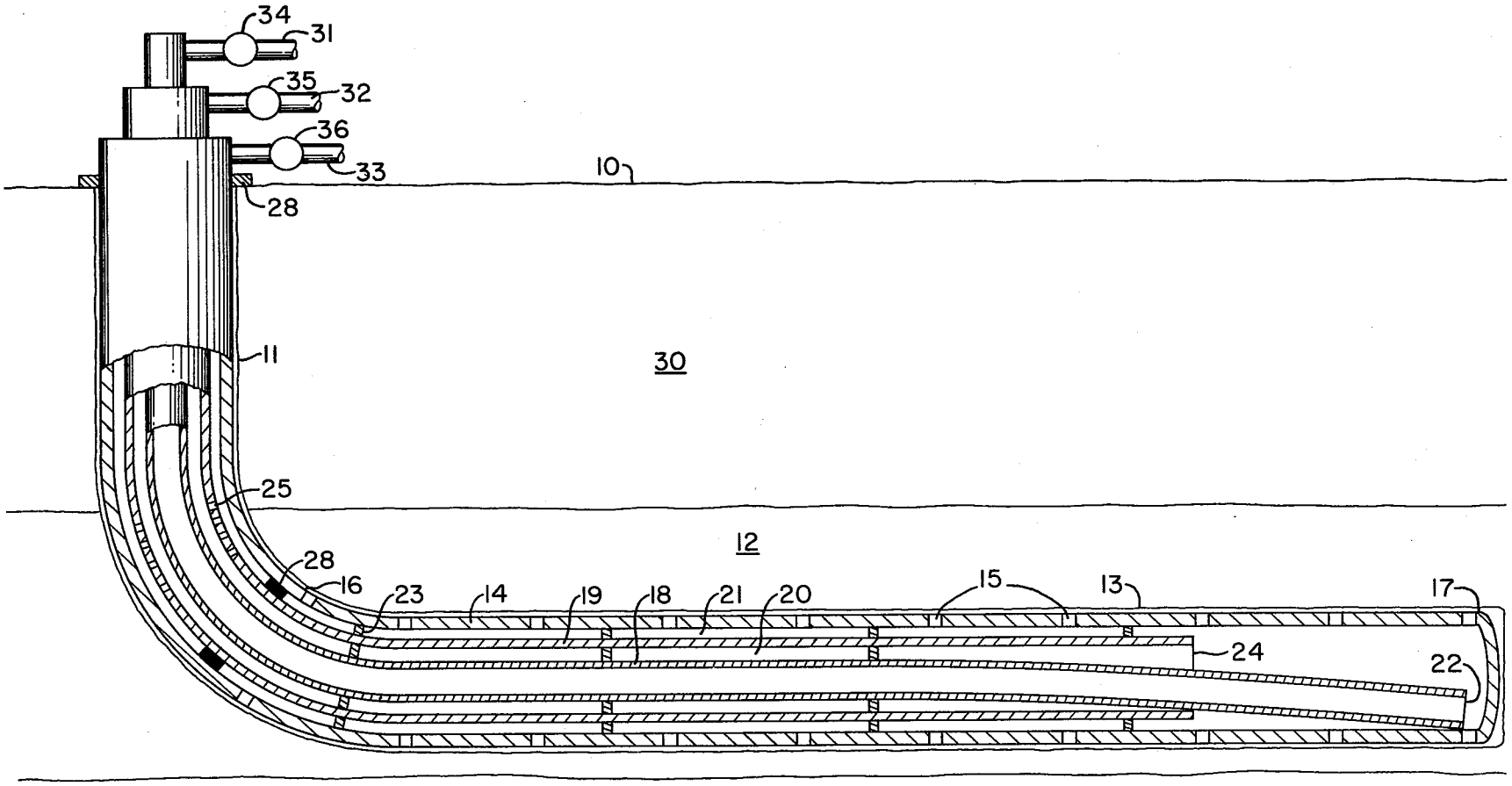
FIG. 2 illustrates a vertical section of another embodiment of the well completion apparatus of FIG. 1.

FIG. 2 illustrates the well completion apparatus for another embodiment of this invention. The well is substantially the same as the well completion assembly illustrated in FIG. 1 except that the apparatus in FIG. 2 also includes (1) a packer assembly 28 disposed between the liner 14 and the outer tubing 19 to bar fluid communication in annular space 21 at a point above the uppermost perforations 15 and, (2) a plurality of passages 25 in outer tubing 19 to provide fluid communication between the annular space 20 and the annular space 21 above the packer.

In practicing another embodiment of this invention and referring to FIG. 2, a wellbore is drilled to penetrate the tar sand formation and to extend substantially horizontally therethrough for a suitable distance. The well is completed in any convenient manner with a slotted or perforated casing element 14, dual concentric tubing strings 18 and 19, and a packer means 28.

After completion of the wellbore, a heated fluid is circulated down the inner tubing 18 and up the annular space 20. Circulation of the heated fluid heats and mobilizes the bitumen which has accumulated in the annular space 21 below the packer 28. The mobilized bitumen drains to the lower end 24 of the outer tubing and is swept to the earth's surface through the annular space 20 and/or through perforations 25 and up the annular space 21 above the packer.

After the well is suitably heated, a heated fluid is injected into the formation through the inner tubing and/or through the annular space 21 above the packer and through passages 25 into annular space 20. The fluid is injected under sufficient pressure to drive the heated fluid into the formation. Preferably, a gas is introduced into the annular space 20 above the uppermost passages 25. This gas provides insulation between at least a portion the inner tubing and the annular space 21.

After a suitable heating interval, and preferably after permitting the formation to soak for a period of time, the well is placed on production by gradually reducing the pressure in annular space 21. The formation pressure drives production fluids including bitumen through the lower portion of annular space 20 through perforations 25 and up the annular space 21 above the packer to the surface of the earth. Low pressure steam may be injected through inner tubing 18 to heat the production fluids and to provide assistance in lifting the fluids to the surface.

The diameter and length of the horizontal wellbore is not critical to the practice of this invention and will be determined by conventional drilling criteria, the characteristics of the formation, and the economics of a given situation. However, the horizontal portion of the wellbores are typically from about 7 to 11 inches in diameter and from about 200 to 9000 feet in length. To best exploit the effects of gravity in recovering the bitumen, the horizontal section of the well should be formed near the bottom of the hydrocarbon-bearing formation. In addition, the boreholes may have a slightly downward or upward slope depending on the well completion apparatus to facilitate production of the bitumen to the earth's surface.

The composition of the liner and the concentric tubing strings is a function of such factors as the type of injected fluid, flow rate, temperature, and pressure employed in a specific operation. The materials of construction may be the same or different, and may be selected from a wide variety of materials including steel. Sometimes it is desirable for the upper portion of the liner 14 to be firmly secured within the borehole by a cement sheath (not shown).

The steam injected into the formation in the practice of this invention can be generally high or low quality steam. Preferably, the steam is at least 50% quality and more preferably about 70–90%. The steam may be mixed with noncondensable gases such as air or flue gas or with solvents such as methane, ethane, propane, butane, pentane, kerosene, carbon dioxide, carbon disulfide or hydrogen sulfide.

The temperature of the heated fluid injected into the formation can be at any suitable temperature which is capable of mobilizing bitumen in the tar formation. This temperature typically ranges from about 350° F to about 700° F.

Although the above embodiments illustrate horizontal deviated boreholes, drilled from the earth's surface it is within the scope of this invention to carry out the method in a stratum exposed at the face of a slope or cliff or in a stratum penetration by a tunnel or vertical shaft. Moreover, the invention can be carried out in a tar sand stratum exposed by an open pit mining process.

Whereas the invention has been described in connection with the recovery of hydrocarbons from subterranean tar sand deposits, it is also within the scope of this invention to employ the apparatus and method described herein to any subterranean strata containing liquids which can be stimulated by thermal energy.

FIELD EXAMPLE

This invention may be better understood by reference to the following example which is offered only as an illustrative embodiment of the invention and is not intended to be limited or restrictive thereof.

A tar sand formation is located at a depth of 1420 feet and has a thickness of 75 feet. The hydrocarbon viscosity is so high that it is essentially immobile at the formation temperature. The formation temperature is 40° F, the formation pressure is 600 psig, and the formation permeability is 1000 millidarcies.

A wellbore is drilled to the formation and extended substantially horizontally 1275 feet along the bottom of the tar sand formation. Referring to FIG. 1, the well is completed with a slotted steel liner 14 which is 7⅝ inches in diameter. The liner slots 15 are about 0.01 inch in width. Dual concentric steel tubing strings are positioned in the liner. The lower end 22 of the inner tubing 18 extends to within 5 feet of the lower end of the liner and the lower end 24 of the outer tubing 19 extends to within 25 feet of the liner's end. The lower portion of the inner tubing rests on the bottom of the slotted liner. The inner tubing has a 2⅞ inches diameter and the outer tubing has a 5½ inches diameter.

After completion of the well, steam is introduced into annular spaces 20 and 21 at a pressure of 750 pounds per square inch and condensate is removed through tubing 18. Steam flow is first established through annular space 20 because steam flow through annular space 21 is blocked with bitumen which has accumulated therein during well completion. After about 8 hours of steaming down annular space 20, steam flow is also established in annular space 21. At this point steam flow through annulus 20 is discontinued and annulus 20 is purged with gas to provide insulation. Steam circulation continues for 8 hours to heat the well and to remove bitumen therefrom. Thereafter, steam of essentially 100 percent quality is injected into the formation through the annular space 21 at a flow rate of 250,000 lb/hr. at a pressure of 2000 psi for about 10 days; condensate removal is continued through inner tubing 18. Steam injection is then discontinued and the well is shut-in for 7 days.

During this soaking period, liquids including some oil, continue to be produced through the inner tubing 18 with the rate controlled so as to prevent steam bypassing. Following the heat soak period, formation hydrocarbons together with water, steam and gas are allowed to flow up tubing 18 and tubing 19. Tubing 19 is used in addition to 18 in order to reduce pipe friction by providing a greater flow area. In some cases, when productivity is low, it is desirable to use only tubing 18.

During the production cycle, a small flow of natural gas is introduced into annulus 21 to provide insulation.

Hydrocarbon liquids are produced at an average rate of about 1200 barrels per day for a period of 50 days. Although the pressure in the horizontal wellbore gradually deceases, production is maintained by reducing the wellhead pressure. At the end of the production cycle, the bottom hole pressure is less than 100 psig with a wellhead pressure of 30 psig. If percolation becomes poor during the production cycle due to production fluids being devoid of water or due to production fluids having a temperature below the boiling point of water, the flow is assisted by the introduction of either hot gas or steam down the outer annulus 21. At the end of the production cycle, injection of the steam is resumed and the cycle of injection and production is repeated until the reservoir being treated is depleted to the point where further production is no longer economically feasible.

Various modifications and alterations of this invention will become apparent to those skilled in the art without departing from the scope and spirit of this invention and it should be understood that this invention is not to be unduly limited to that set forth herein for illustrative purposes.

What we claim is:

1. A method for recovering hydrocarbons from a subterranean formation containing viscous hydrocarbons comprising, drilling a well to said formation and extending the well into said formation;

completing the well with a casing means and with dual concentric tubing strings comprising an inner tubing and a larger diameter outer tubing, the inner tubing forming a first flow path, the inner tubing cooperating with the outer tubing to form a second flow path, and the outer tubing cooperating with the a second flow path, and the outer tubing cooperating with the casing means to form a third flow path, said casing means extending substantially the length of said well and containing passages to allow formation hydrocarbons to enter said casing means;

circulating a heated fluid within the casing means until flow of said heated fluid is established in each of said flow paths;

injecting heated fluid into the formation through at least a portion of said third flow path after flow of said heated fluid has been established by circulation within said casing means;

producing formation hydrocarbons from the formation by means of the well.

2. The method as defined in claim 1 wherein the subterranean formation consists essentially of tar sand.

3. The method as defined in claim 1 wherein the hydrocarbon is substantially bitumen.

4. The method as defined in claim 1 wherein the wellbore extends for at least 200 feet through the formation.

5. The method as defined in claim 1 wherein said circulated heated fluid is steam.

6. The method as defined in claim 1 wherein said heated fluid injected into said formation comprises steam.

7. The method as defined in claim 6 wherein said heated fluid further comprises hydrogen sulfide.

8. The method as defined in claim 1 wherein the steps of injecting heated fluid into the formation and producing formation hydrocarbons are repeated several times.

9. The method as defined in claim 1 wherein a portion of said well is extended substanially horizontally into said formation.

10. The method as defined in claim 1 wherein the formation hydrocarbons are produced through the first flow path.

11. The method as defined in claim 1 further comprising producing heated liquids through the inner tubing and simultaneously injecting heated fluids into the formation through the third flow path.

12. The method as defined in claim 11 wherein the heated liquid includes steam condensate.

13. The method as defined in claim 1 futher comprising introducing an insulating gas into at least a portion of the second flow path to displace the heated fluid therefrom after circulation of the heated fluid within the casing means.

14. The method as defined in claim 1 wherein the formation hydrocarbons are produced through at least a portion of the third flow path.

15. The method as defined in claim 1 further comprising after circulation of the heated fluid within said casing means introducing into said second flow path an insulating gas.

16. The method as defined in claim 15 wherein said gas is selected from the group consisting of hydrocarbon gases, carbon dioxide or nitrogen.

17. The method as defined in claim 1 further comprising simultaneously with production of bitumen from the formation injecting steam into the third flow path.

18. The method as defined in claim 1 wherein formation hydrocarbons are produced through the first and the second flow paths.

19. The method as defined in claim 18 further comprising injecting a gaseous fluid down the third flow path simultaneously with production of the formation hydrocarbons.

20. A method for recovering viscous hydrocarbons from a subterranean formation containing viscous hydrocarbons comprising, drilling a borehole to said formation and extending said borehole into said formation;

extending casing means into said wellbore for substantially the entire length thereof, said casing means containing passages to allow formation fluid to enter said casing means;

disposing within said casing means dual concentric tubing strings comprising an inner tubing and a surrounding larger diameter outer tubing, said inner tubing cooperating with said outer tubing to form a first annular space and said outer tubing cooperating with said casing means to form a second annular space;

circulating a heated fluid down said first annular space and up said inner tubing to heat said inner and outer tubings;

introducing a gas into the first annular space to displace said heated fluid therefrom;

injecting a second heated fluid into the formation through said second annular space;

producing formation hydrocarbons from the formation through the inner tubing.

21. A method for recovering viscous hydrocarbons from a viscous hydrocarbon-bearing formation comprising, drilling a wellbore to said formation and extending said wellbore through the formation;

completing the wellbore with a casing means containing passages to allow formation hydrocarbons to flow into the casing means, with dual concentric tubing comprising an inner tubing and a larger diameter outer tubing disposed is said casing means, and with a packer means disposed between the outer tubing and casing means at a point above the passages of said casing means, said inner tubing cooperating with said outer tubing to form a first annular space and said outer tubing cooperating with said casing means to form a second annular space, said outer tubing containing passages at a point above the packer to allow fluid flow between the first annular space and the lower portion of the second annular space above the packer;

circulating a heated fluid in the casing means such that the heated fluid flows through at least a portion of the second annular space;

injecting a second heated fluid into the formation through at least a portion of the third annular space below the packer;

producing hydrocarbons from the formation through at least one of the flow conduits.

22. A method for recovering bitumen from a subterranean tar sand formation comprising, drilling a wellbore to the tar sand formation and extending the wellbore into the formation;

completing the wellbore with a casing means and disposed in said casing means, dual concentric tubing strings comprising an inner tubing and a larger diameter outer tubing, said inner tubing cooperating with said outer tubing to form a first annular space and said outer tubing cooperating with said casing means to form a second annular space, said casing means having passages to allow the formation bitumen to flow into the casing means;

circulating a heated fluid down said first annular space and up said inner tubing;

circulating the heated fluid down said second annular space and up the inner tubing;

thereafter injecting a heated fluid into the formation through the second annular space;

producing bitumen from the formation through the first flow path.

* * * * *